US005131051A

United States Patent [19]

Kishinaga et al.

[11] Patent Number: 5,131,051

[45] Date of Patent: Jul. 14, 1992

[54] METHOD AND APPARATUS FOR CONTROLLING THE SOUND FIELD IN AUDITORIUMS

[75] Inventors: Shinji Kishinaga; Yasushi Shimizu; Fukushi Kawakami, all of Hamamatsu, Japan

[73] Assignee: Yamaha Corporation, Hamamatsu, Japan

[21] Appl. No.: 592,261

[22] Filed: Oct. 3, 1990

[30] Foreign Application Priority Data

Nov. 28, 1989 [JP] Japan ..... 1-308530

[51] Int. Cl.[5] ..... H04R 27/00

[52] U.S. Cl. ..... 381/82; 381/83; 381/77; 381/80; 381/63; 381/64

[58] Field of Search ..... 381/82, 83, 77, 80, 381/64, 63

[56] References Cited

U.S. PATENT DOCUMENTS 3,614,320 10/1971 Volkmann ..... 381/64

5,025,472 6/1991 Shimizu et al. ..... 381/83

OTHER PUBLICATIONS

"Delta Stereophony-A Spind System with True Direction and Distance Perception for Large Multipurpose Halls" by Gerhard Steinke, Jul./Aug. 1983. J. Andio Eng. Soc. vol. 31 No. 7 1983 Jul./Aug.

*Primary Examiner*—Forester W. Isen

*Assistant Examiner*—Nina Tong

*Attorney, Agent, or Firm*—Spensley, Horn, Jubas & Lubitz

[57] ABSTRACT

A system for controlling the second field in auditorium having the feature that stage and audience seating areas are different acoustically, which includes a first assisted acoustics system whereby acoustical energy from the stage area is input, and then controlled acoustic energy is supplied to the audience seating area, and a second assisted acoustics which is provided independently of the first electronic acoustical augmentation system, whereby acoustical energy from the audience seating area is input, and then controlled acoustic energy is supplied to the stage area. Each assisted acoustics system includes acoustic energy input devices and acoustic energy output devices whereby a uniform rate of power decay coefficient can be effected throughout the hall, including spaces under balconies and the like. Significantly improved the degree of acoustic similarity between the stage area and audience seating area is achieved by controlling reverberation characteristics.

18 Claims, 6 Drawing Sheets

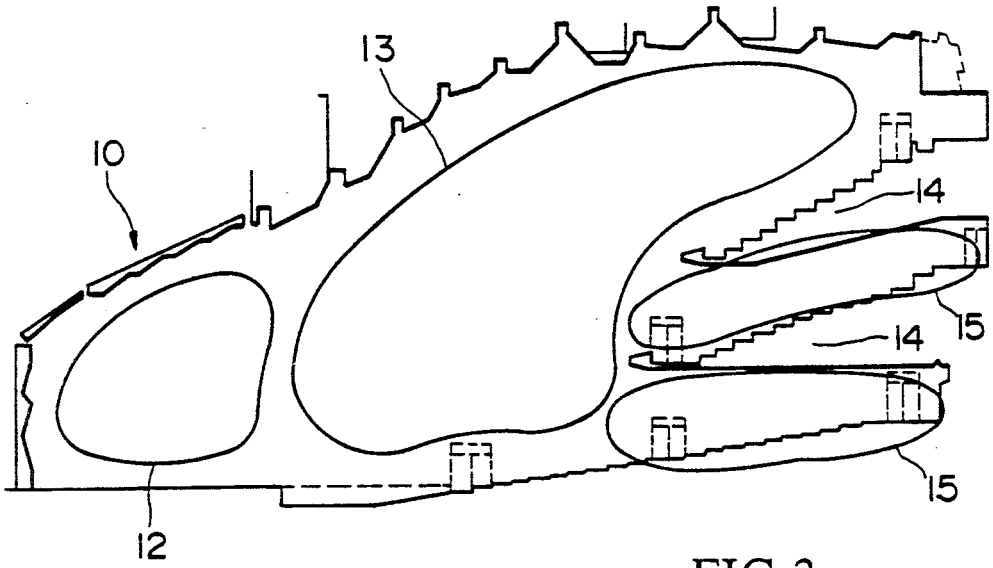
FIG.3
FIG.5(A)
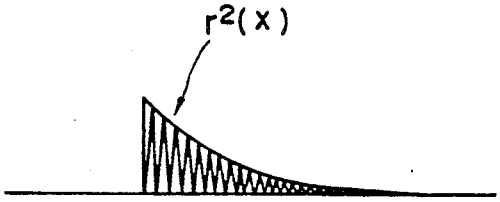
FIG.5(B)
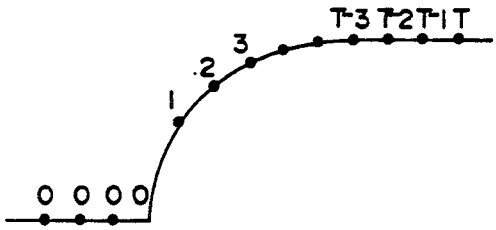
FIG.5(C)
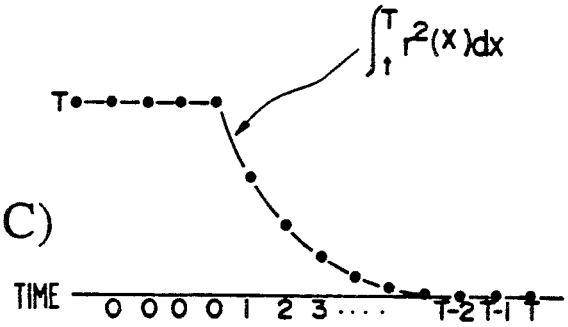
FIG.5(D)
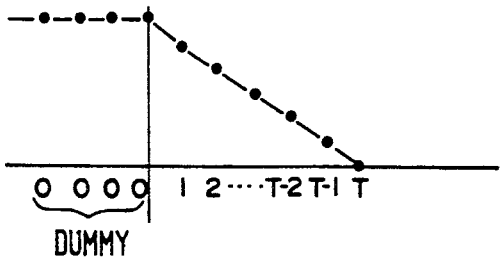

METHOD AND APPARATUS FOR CONTROLLING THE SOUND FIELD IN AUDITORIUMS

BACKGROUND OF THE INVENTION

1. Field of the Invention

The present invention relates to methods and an apparatus for controlling the acoustic characteristics of concert halls, multipurpose halls and the like.

2. Prior Art

With multipurpose halls or the like, orginarily the acoustic characteristics of the space surrounding the stage and that of other areas, for example the space surrounding the audience seating area, differ considerably. In contrast, concert halls which have been specifically designed for performing classic music and the like, so-called one-room type halls, generally demonstrate uniform acoustic characteristics throughout.

Multipurpose halls frequently include structural features not found in concert halls, such as the proscenium arch through which the space surrounding the stage and the space surrounding the audience seating area communicate. Additionally, multipurpose halls often incorporate removable acoustical reflectors in the space surrounding the stage. Halls employing acoustical reflectors offer certain advantages from the standpoint of the performers in that, because the stage area is relatively small space compared with the audience seating area, the sound reflected towards the performers has improved acoustic characteristics. On the other hand, it is very difficult to maintain uniform acoustic characteristics throughout this kind of hall. Because the musicians' perception of the acoustic characteristics of their musical performance differs considerably from that of the audience, performing in this kind of hall so as to deliver a musical performance having the best possible acoustic characteristics in the audience seating area is exceedingly difficult.

From the standpoint of the audience, the acoustic characteristics of conventional multipurpose halls lend to a sense of separation between the stage area where the musical performance is taking place and the audience seating area, in other words, the sense of presence perceived by the audience is insufficient. Putting it differently, the structural characteristics of conventional multipurpose halls lead to loss of acoustical similarity between the stage area and the audience seating area.

As one means to improve the acoustical similarity between the stage area and the audience seating area in a multipurpose hall, a method has been proposed wherein the acoustic characteristics of the hall are controlled so that early reflected sound and reverberation time are each equalized throughout the sound field in a hall. The sound field formed by an actual hall, however, is not a theoretical, ideal sound field, and further, since reverberation characteristics are determined by early reflected sound and reverberated sound within an actual hall, their sounds are not independent of one another. Thus, controlling the architectural structure of a hal so as to vary one of the two parameters will result in changes in the other parameter, for which reason uniform acoustic characteristics cannot be practically achieved throughout the interior of this kind of hall.

SUMMARY OF THE INVENTION

In consideration of the above, an object of the present invention is to provide a method and apparatus for controlling the sound field in auditoriums whereby it is possible to create the effect of the degree of acoutstical similarity that is characteristic of the sound field of one-room type halls, in a hall in which the stage area and the audience seating area are actually physically separated from one another.

As a result of research by the inventors of the present invention, it has been found that the ratio of the power decay coefficient is a suitable measure of the degree of acoustical similarity for any two given areas in an acoustic chamber under analysis. This finding is supported by experimental data resulting from experiments carried out by the present inventors, which will be presented below.

to start with, consideration will be given to the physical meaning of the power decay coefficient, from which the ratio of the power decoy coefficient is calculated. Following the momentary generation of a pulsive sound, for example a gun shot, the decay of sound pressure as well as the decay of sound energy are gradually diminishing exponential functions. Due to the exponential nature of these functions, functions describing the envelope of the decay of sound pressure and sound energy are employed so as to simplify calculations. Assuming that p(t) is a function of time t describing the envelope of the sound pressure, and that $p^2(t)$, which is the square of p(t), is a function of time describing the envelope of the sound energy, center of gravity time ts can be defined in terms of the ratio of the moment of first order of $p^2(t)$ to the moment of zeroth order of $p^2(t)$, as shown in Equ. 1 below:

$$ts = \frac{\int_0^{\infty} t \cdot p^2(t)dt}{\int_0^{\infty} p^2(t)dt} \qquad \text{Equ. 1}$$

The envelope of the decay of sound energy can be expressed in terms of the decay coefficient δ, such that $p^2(t)=e^{-\delta t}$. Substituting this term into Equ. 1, and integrating with respect to time, the intermediate result expressed in terms of $RT_{60}$ shown in Equ. 2 below results, whre $RT_{60}$ is the reverberation time. The reverberation time $RT_{60}$ is defined as the time in seconds required for the average sound-energy density to decrease to one millionth of its initial steady state value after the sound source has stopped, that is , a reduction by 60 decibels. At time t=0, it can be seen that the envelope of the decay of energy as expressed by $p^2(t)=e^{-2\delta t}$ is equal to one ($e^{-2\delta x0}$32 $e^0=1$). Thus, at time $RE_{60}$ when the sound energy envelope has decreased to one millionth of teh value at time t =0, $e^{-2\delta t}$ is equal to $10^{-6}$, from which it can be determined that $RT_{60}$ is approximately equal to 13.8/2δ. Substituting this value for $RT_{60}$ into the intermediate term in Equ. 2 gives ts expressed in terms of δ as shown in the final term in Equ. 2 below:

$$ts = \frac{RT_{60}}{13.8} = \frac{1}{2\delta} \qquad \text{Equ. 2}$$

The ratio of ts for the audience seating area ($ts_{aud}$) to ts for the stage area ($ts_{stage}$) is shown in Equ. 3 below:

$$[ts_{ratio}] = \frac{[ts_{aud}]}{[ts_{stage}]} = \frac{2\delta_{stage}}{2\delta_{aud}} = \frac{\delta_{stage}}{\delta_{aud}} \qquad \text{Equ. 3}$$

Sustituting $e^{-2\delta t}$ for $p^2(t)$ in the function which is to be integrated in the numerator of the expression shown in Equ. 1, and then differentiating as is shown below:

$$\frac{\partial t \cdot p^2(t)}{\partial t} = \frac{\partial t \cdot e^{-2\delta t}}{\partial t} = (1 - 2\delta t)e^{-2\delta t},$$

then setting the result of the differentiation equal to zero as further shown belos:

$0=(1-2\delta t)e^{-2\delta t}$ therefore, $0=1-2\delta t$, then solving for t gives $t=\frac{1}{2}\delta$ which is the value for t at which $t.p^2(t)=t.e^{-2\delta t}$ reaches a maximum value. From this derivation, it can be seen that ts is determined theoretically based on the waveform properties of $t.p^2(t)$ itself.

On the other hand, the rise time (hereafter TR) and early decay time (hereafter EDT), factors conventionally used in the analysis of the acoustic characteristics of halls and the like, are derived as will be described below, first of all, TR is defined as the time required to rise to an energy level equal to one half of the total steady state energy level, in other words, −3 dB relative to the total steady state energy level. From this definition, the following equality follows by necessity:

$$\int_0^{TR} p^2(t)dt = \int_{TR}^{\infty} p^2(t)dt$$

In halls having different acoustic characteristics, the value corresponding to one half of the total steady state energy in the above equation will be different.

EDT is efined as the time corresponding to the point on the reverberation decay envelope at which the decay reaches −10 dB. In this respect, the definition of EDT is similar to that of $RT_{60}$. As with TR as descxribed above, in halls having different acoustic characteristics, the value for EDT will be different. Both TR and EDT serve as measures for specific characteristics of a hall which are secondary to the fundamental acoustic characteristics of the hall as a whole. In contrast, center of gravity time ts and the ratio of the power decay coefficient $ts_{ratio}$ correspone to definite physical quantities, as can be appreciated from the definitions of ts and $ts_{ratio}$ above. For this reason, ts and $ts_{ratio}$ represent more meaningful and reliable measures of the acoustic characteristics of a hall, on which basis various predictions and comparisons can be made.

In FIG. 6, examples of $p^2(t)$ and $t.p^2(t)$ are shown in terms of the pulse response of a reverberation chamber. When an ideal pulse response is assumed, ts is not effected by direct sound, as is clear from its definition in Equ. 1. Thus, the physical quantity expressed by ts is essentially independent of the distance from the sound source. For this reason, measurements of acoustic characteristics based on ts are characterized in that they provide useful and reliable data, even under the circumstances of a multipurpose hall in which the distance from the sound source, i.e. the stage, to any of one of the seats in the audience seating area varies over a wide range.

As is shown in FIG. 7, in the case of actual measurement of acoustic characteristics, measured values for ts are best interpreted in consideration of the duration of a generated sound signal. For this reason, at each measurement point, ts is determined starting only with values of TR expressing the time for sound to travel directly from the sound source to the measurement point, that is, for t=0, t=−D/2, where D is the duration direct of sound. In this way, effects due to direct sound, in other words, effects due to distance of separation are eliminated. Assuming a value for $RT_{60}$ on the order of two seconds, for a time of on the order of $RT_{60}/3$ or greater, accuracy to two digits to the right of the decimal point (±5 msec) can be assumed for ts, which should be sufficient suitable for the measurements under rconsideration.

Next, in order to examine the behavior of ts and the effectiveness of $ts_{ratio}$, ts is determined assuming a multipurpose hall with an removable accostical reflector above the stage area and a proscenium arch opening of variable aperture (Y hall). In FIG. 8, the hall configuration, sound source 1, and the position of measuring point 2 are shown. ts is also determined with the removable acoustical reflector 3 positioned as shown be A and C in FIG. 8, and also in state D with curtains located at either side of the stage (not shown in FIG. 8). For these measurements, the position of measuring point 2 and the acoustic conditions in the audience seating area are hled constant. Compared with position C, when the removable acoustical reflector 3 is in position A, more favorable conditions are created such that acoustics closer to those of a one-room type hall are achieved, or in other words, improved acoustic similarity is achieved.

The results of the above described measurements of ts are shown in FIGS. 9 and 10. FIGS. 9 and 10 represent the situations when the sound source 1 is in the positions $S_1$ and $S_2$ in FIG. 8, respectively. Since the effect of direct sound has been eliminated as described previously, ts becomes smaller as the distance from the sound source becomes less, due to primary reflection of sound from the floor. As is shown in FIG. 9, by varying the positions A and C of removable acoustical reflector 3, differences are introduced into the value of ts for the stage area, whereas ts is essentially constant for the audience seating area.

Taking the average ratio of values for ts shown in the graph of FIG. 9 for the audience seating area and for the stage area, such that the distance from the sound source for each are equal and in the range of 6 to 12 m, it can be seen that for conditions D when the curtains are provided, the ratio is 1.86, for general conditions C, the ratio is 1.30, and for conditions A which are close to the conditions of a one-room-type-hall, the ratio is 1.10. Thus, it can be understood that as the conditions of the hall approach those of a one-room-type-hall, $ts_{ratio}$ approaches unity.

On the other hand, as can be seen from FIG. 10, the difference of ts between conditons A and conditons C varies essentially symmetrically with distance from the junction between the stage area and the audience seating area. Further, the ratio of the average value of ts for the audience seating area and that of the stage area (10 to 12 m from the sound source) shows the same results, from which fact it can be appreciated that $ts_{ratio}$ under these conditions is relatively independent of position with respect to the sound source.

When the same measurements and considerations are given to the hall shown in FIG. 11 (hall Z), the values shown for ts in FIG. 12 result. In the case of the hall of FIG. 11 as well, as the conditions of the hall approach those of a one-room-type-hall, $ts_{ratio}$ approaches unity.

The results of the above described measurements are shown in Table 1 below.

TABLE 1

| Stage Conditions | Hall Y sound source S1 | Hall Y sound source S2 | Hall Z sound source S1 |
|---|---|---|---|
| Conditions D: curtains in place | 1.86 | 2.06 | — |
| Conditions C: acoustic reflector in place | 1.30 | 1.30 | 1.26 |
| Conditions A: acoustic reflector adjusted to simulate one-room-type-hall | 1.10 | 1.11 | 1.10 |

all values represent $ts_{ratio}$

The values shown in Table 1 above reflect changes in acoustic characteristics due to changes in the interior architectural features of each respective hall. In Table 2 below, the height, width and cross-sectional area of the proscenium arch are compared with those of the audience seating area. As is evident from Table 2, the relative horizontal dimensions for hall Z and the relative vertical dimensions for hall Y most closely approach those for a one-room-type-hall, that is, the ratio of the respective dimensions are closest to unity. The ratio of the cross-sectional area of the audience seating area to that of the proscenium arch is approximately equal for hall Y and hall Z.

TABLE 2

| Relative Dimensions | Conditions | Hall Y | Hall Z |
|---|---|---|---|
| Relative Horizontal Dimensions ($W_a/W_p$) | | 30/20 = 1.5 | 18/14 = 1.29 |
| Relative Vertical Dimensions ($H_aH_p$) | A | 15.5/11.8 = 1.5 | 14/9 = 1.56 |
| | C | 15.5/9.5 = 1.5 | 14/7.5 = 1.87 |
| Relative Cross-Sectional Area ($W_aH_a/W_pH_p$) | A | 1.97 | 2.00 |
| | C | 2.45 | 2.40 |

all values represent $ts_{ratio}$
proscenium arch height, width: $H_p$, $W_p$
audience seating area height, width: $H_a$, $W_a$ In Table 3 below, the results of determinations for TR and EDT for hall Y and hall Z under the conditions discussed above are presented. For hall Y when curtains are in place (conditions D), the value for TR reaches its highest value at approximately four times greater than when no curtains are in use (conditions A). Further, under conditions D, the value of TR varies with placement of the sound source, whereas EDT scarcely changes. Because $RT_{60}$ is equal to approximately 1.45 sec, EDT is essentially the same as that for hall Z with an removable acoustical reflector in place. Thus, it can be seen that these parameters alone are not sufficient for judging the degree of acoustic similarity. Moreover, for the purpose of establishing a one-room-type-hall effect, TR and EDT are not sufficiently reproducible.

TABLE 3

| Stage Conditions (sound source S1) | Hall Y TR Ratio | Hall Y EDT Ratio | Hall Z TR Ratio | Hall Z EDT Ratio |
|---|---|---|---|---|
| Conditions D: curtains in place | 5.72 (4.88) | 1.22 | — | — |
| Conditions C: acoustic reflector in place | 2.23 (1.84) | 1.11 | 1.86 | 1.19 |
| Conditions A: acoustic reflector adjusted to simulate one-room-type-hall | 1.41 (1.47) | 1.01 | 1.33 | 1.15 |

values in parenthesis are measurements from sound source S2

In the past, evaluation of the acoustical characteristics of halls using conventional techniques has been very difficult and not completely effective. According to the invention, it is possible to objectively evaluate the degree of acoustic similarity between, for example, the stage area and the main audience seating area, using the ratio of the power decay coefficient for each respective area. With the same system, using the assisted acoustics means, the power decay for each area can be regulated so that the power decay coefficient for the respective areas comes to equal one another, thus improving the degree of acoustic similarity throughout the hall, and making it possible to achieve an effect approaching presence of a one-room type hall in a hall in which the stage and audience seating areas are actually physically and acoustically different from one another.

BRIEF DESCRIPTION OF THE DRAWINGS

FIG. 3 is a schematic vertical cross-sectional view of a hall which can be suitably equipped with an apparatus of the first preferred embodiment of the present invention as shown in FIG. 1.

FIG. 5A to 5D show a signal waveform used for explaining the operation of the measurement equipment shown in FIG. 4.

DETAILED DESCRIPTION OF THE PREFERRED EMBODIMENTS

Figure 1:
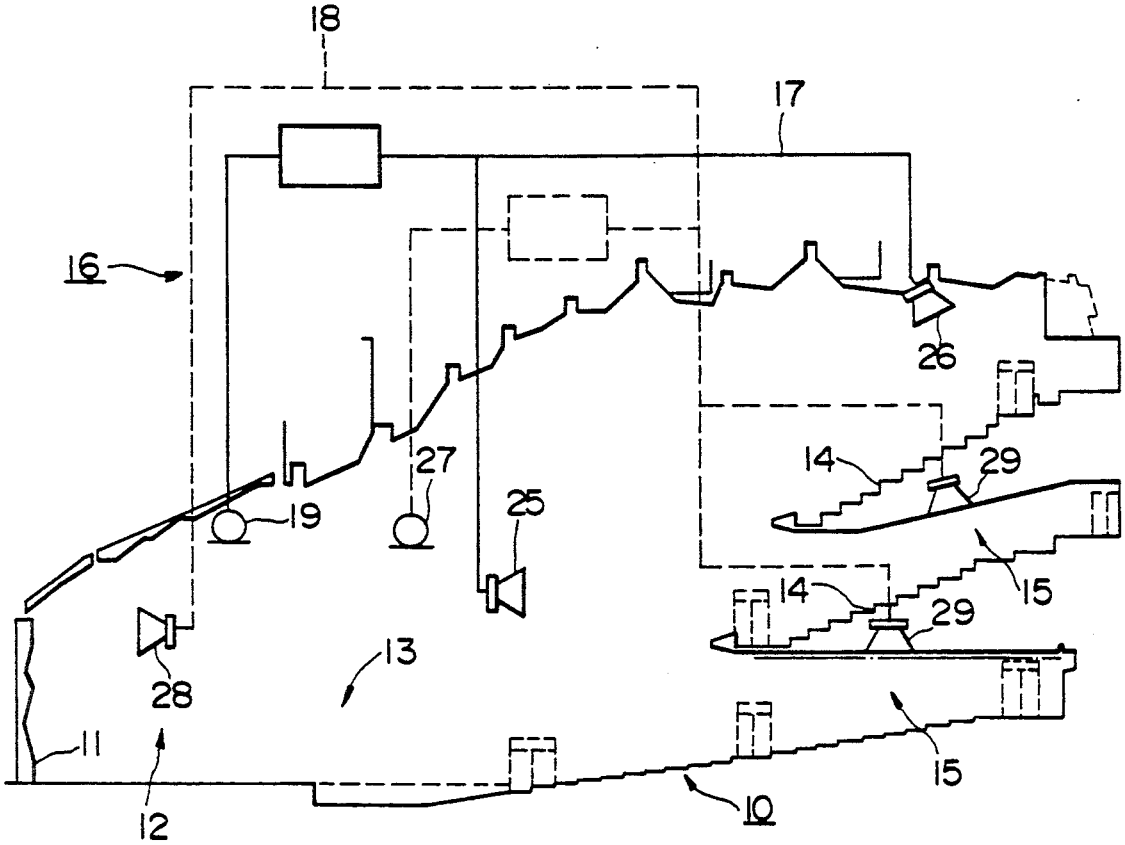
FIG. 1 is a schematic vertical cross-sectional view of a hall equipped with a first preferred embodiment of an apparatus of the present invention.
Figure 2:
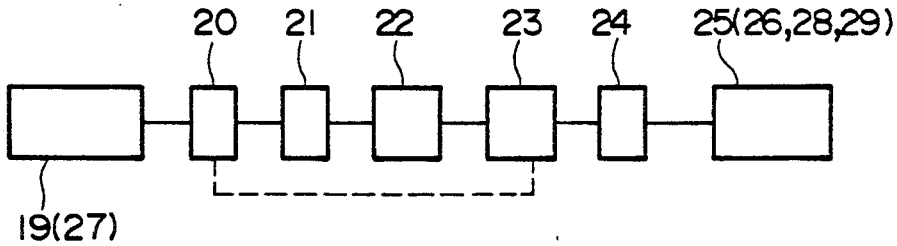
FIG. 2 is a block diagram of the first preferred embodiment of the present invention as shown in FIG. 1.

In FIGS. 1 through 3, a first preferred embodiment of the apparatus of the present invention for controlling the sound field in auditorium, and a hall which may be suitably equipped with the apparatus are shown. The hall 10 includes a stage area 12 which lies behind the proscenium arch opening, and which is surrounded by removable acoustical reflectors 11. The hall 10 also includes a main audience seating area 13, balconies 14 and sub-balcony areas 15 partitioned by balconies 14.

The system apparatus 16 of the first preferred embodiment of the invention is provided in the hall 10. A first assisted acoustics system 17 and second assisted acoustics system 18 are independently provided as components of the apparatus for improving the acoustic characteristics of hall 10.

As shown in FIGS. 1 and 2, the above mentioned first assisted acoustics system 17 includes stage microphones 19, remote mixer 20, equalizer 21, digital signal processor 22, digitally controlled attenuator 23, power amplifier 24, well speakers 25 provided on the walls of the main audience seating area 13, and ceiling speakers 26 provided in the upper rear section of the main audience seating area 13.

The second assisted acoustics system 18 is generally made up of the same components forming the first assisted acoustics system 17, although the microphones are provided as audience seating area microphones 27, and the speakers are provided as reflector speakers 28 facing the acoustical reflectors 11 in the stage area 12, and sub-balcony speakers 29 fitted in the lower portions of the above mentioned balconies 14.

In the following, the operation of the above described apparatus 16 will be explained.

1. Measurement of Reverberation Characteristics

In order to optimize improvement of acoustic similarity throughout the hall 10 using the above described first assisted acoustics system 17 and second assisted acoustics system 18, the reverberation characteristics of hall 10 are first evaluated without use of the first and second assisted acoustics systems 17, 18.

The method for measurement of the reverberation characteristics of hall 10 is capable of using various conventional methods, however in the present embodiment, the method described in Japanese Patent Publication No. Hei 1-35288 which has been assigned to the present applicants, "Method and Apparatus for Measurement of Transient Response Characteristics of Transmission System" and has been employed.

The method disclosed in the above referenced Japanese patent document involves use of the impulse response squaring and integrating process devised by M. R. Schroeder in order to measure reverberation characteristics. The principle of Schroeder's process is that, from the sound source to receiving point impulse response r(x), one attempts to arrive at the average of an infinite number of determinations of the essential propagation characteristics $<S^2(t)>$ of the reverberation decay curve under steady state conditions at a receiving point, immediately after the cessation of band noise. According to this method, the transient response characteristics $<S^2(t)>$ of the sound pressure response level S(t), where t is time, can be expressed in terms of the impulse response r(x) according to the following Equ. 4:

$$<S^2(t)> = N\int_t^{\infty} r^2(x)dx \qquad \text{Equ. 4}$$

In Equ. 4 above, N represents the power of sound source band noise. The infinity term in Equ. 4 can reasonably be approximated by a suitably great time T at which point the sound energy level has essentially decayed to zero. Thus, based on the above Equ. 4, if the square of the impulse response r(x) is integrated over the integration interval <t to T>, one arrives at the average of an infinite number of determinations of the square of the sound pressure response level S(t), in other words the transient response characteristics $<S^2(t)>$, at time t.

Again, according to the above method, to arrive at the reverberation decay curve in an actual chamber, the technique known as the double impulse method is employed. The double impulse method relies on Equ. 5 below, which is derived from Equ. 4 after substitution of T for ∞ as follows:

$$\begin{aligned} <S^2(t)> &= N\int_t^{T} r^2(x)dx \\ &= N\int_0^{T} r^2(x)dx - N\int_0^{t} r^2(x)dx \end{aligned} \qquad \text{Equ. 5}$$

By further subdividing the integration interval <0 to t>, the right hand term of the right side of Equ. 5 can be expressed as shown in Equ. 6 below:

$$\begin{aligned} N\int_0^{t} r^2(x)dx = N\int_0^{t_1} r^2(x)dx + N\int_{t_1}^{t_2} r^2(x)dx + \\ N\int_{t_2}^{t_3} r^2(x)dx \ldots N\int_{t_{n-3}}^{t_{n-2}} r^2(x)dx + N\int_{t_{n-2}}^{t_{n-1}} r^2(x)dx + \\ N\int_{t_{n-1}}^{t_n} r^2(x)dx \end{aligned} \qquad \text{Equ. 6}$$

where $t_n$ is the same as t in Equ. 5, and $<t_1, t_2, \ldots t_{n-2}, t_{n-1}, t_n=t>$ represent sequential values within the integration interval <0 to t>.

Thus, the transient response characteristics $<S^2(t)>$ at time t can be arrived at by first obtaining the integral of the square of the impulse response r(x) over the integration interval <0 to T>, then sequentially subtracting the successively determined integrals of the square of the impulse response r(x) for each interval making up integration interval <0 to t>.

Figure 4:
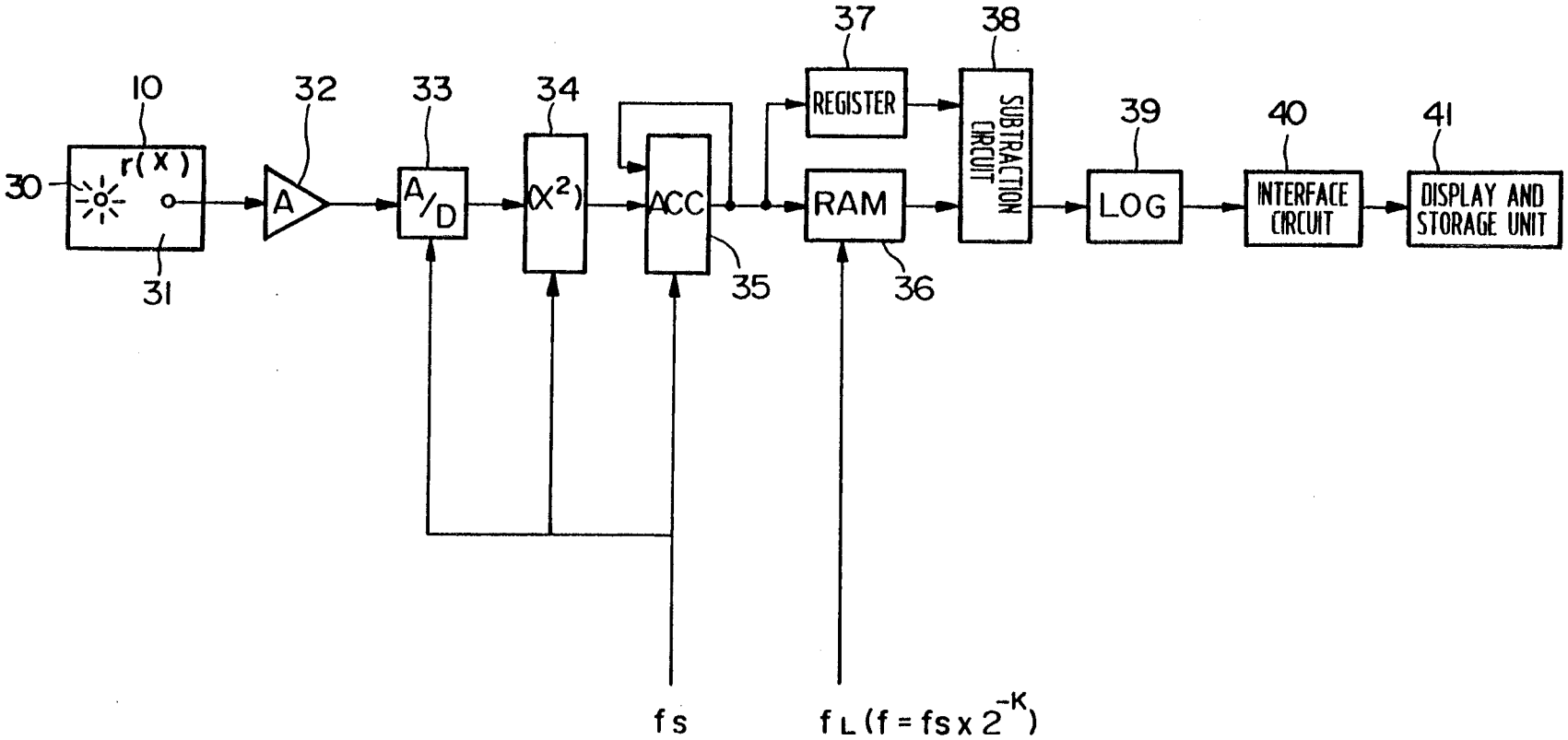
FIG. 4 is a block diagram of equipment for measuring reverberation characteristics which can be suitably employed in the system of the present invention shown in FIG. 1.
Figure 6:
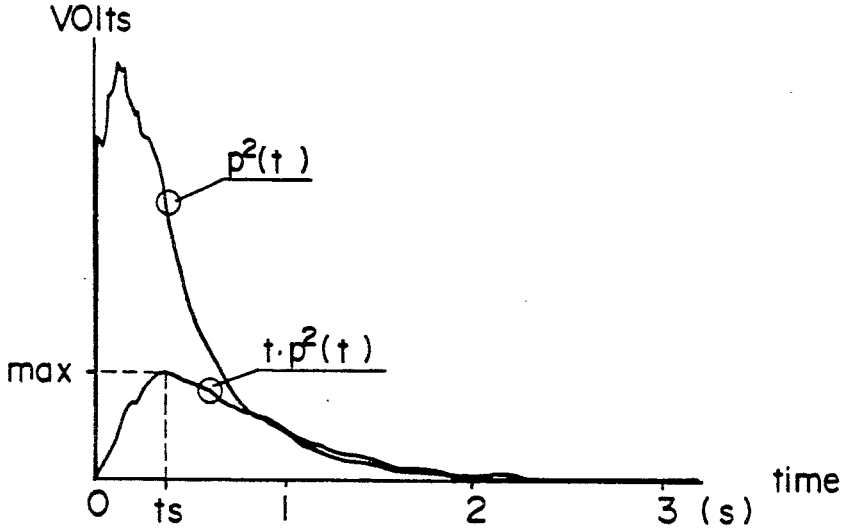
FIG. 6 shows the results of experiments conducted to investigate the characteristics of $ts_{ratio}$, wherein the relationship between the square of sound pressure and the square of sound pressure multiplied by time is shown in terms of pulse response.
Figure 7:
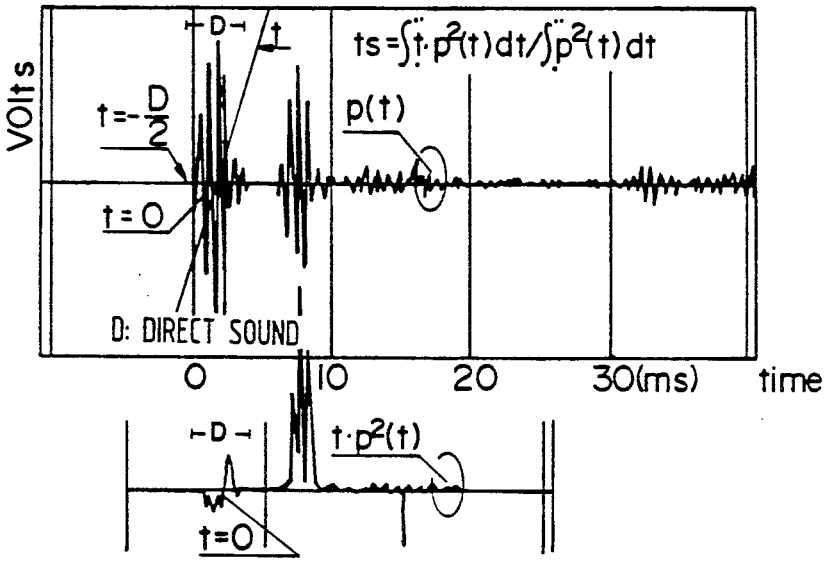
FIG. 7 is a diagram for explaining the starting point of measurements of the center of gravity time ts with respect to time.
Figure 8:
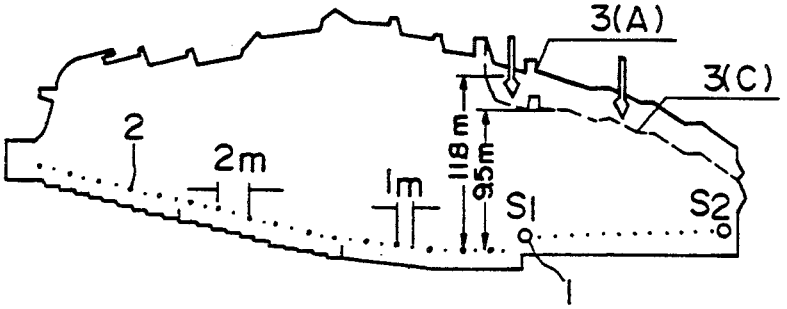
FIG. 8 is a schematic vertical cross-sectional view of a hall Y used for experimental purposes.
Figure 9A:
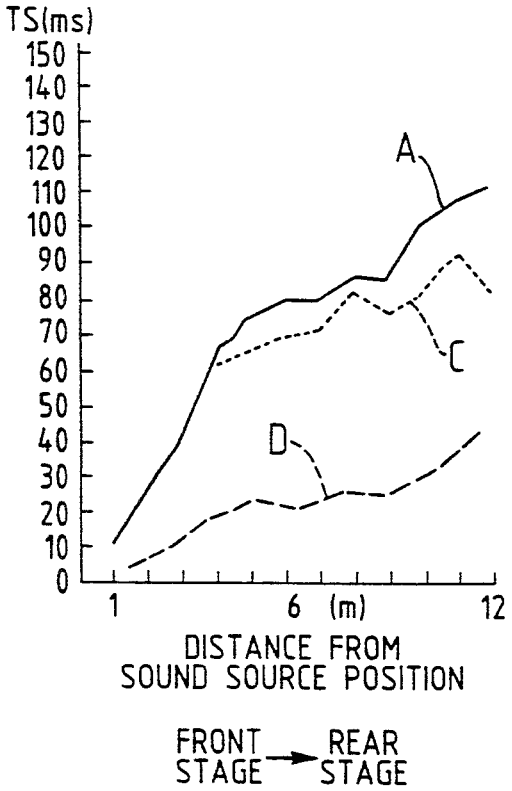
FIGS. 9A and 9B are diagram for demonstrating one example of the relationship between measurement position and center of gravity time ts with respect to time in hall Y which is shown in FIG. 8.
Figure 9B:
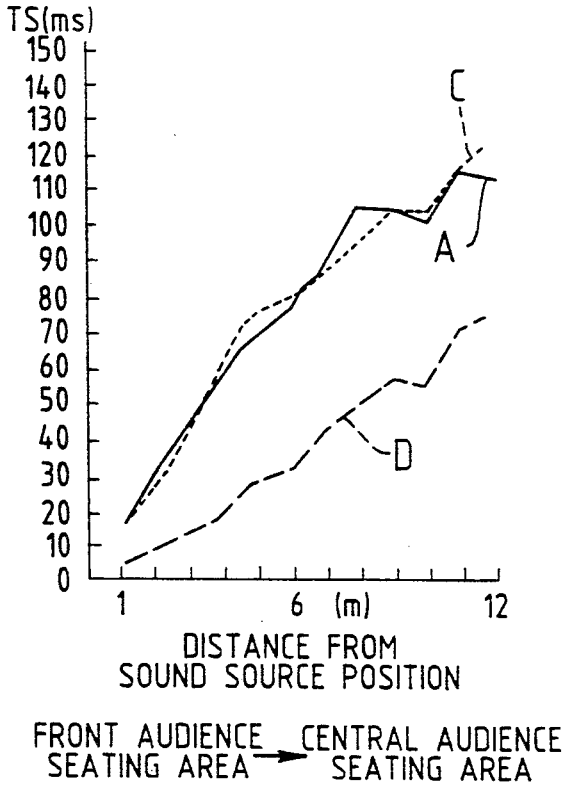
Figure 10:
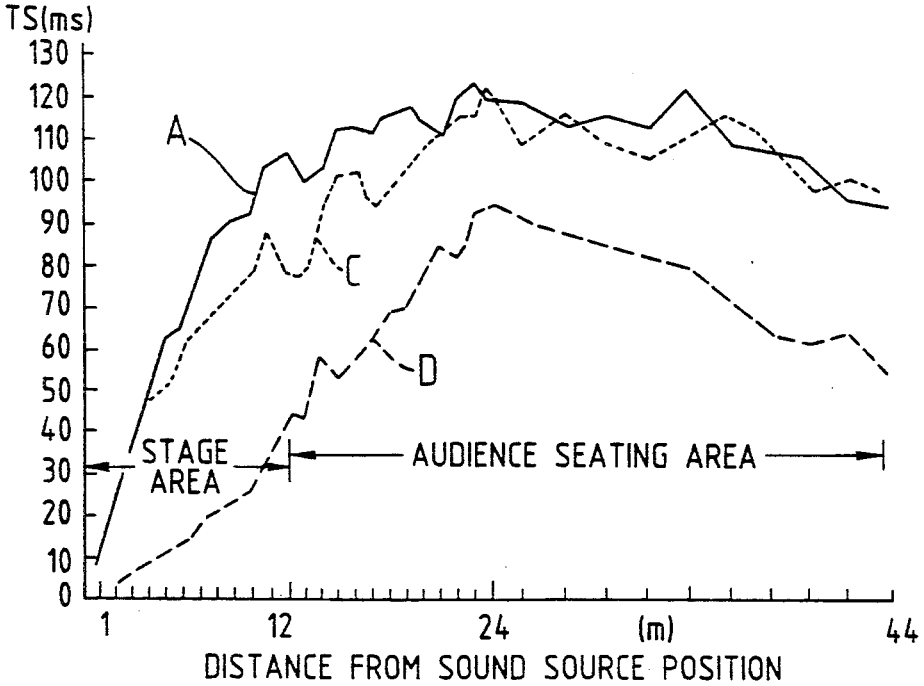
FIG. 10 is a diagram for demonstrating another example of the relationship between measurement position and the center of gravity time ts with respect to time in hall Y which is shown in FIG. 8.
Figure 11:
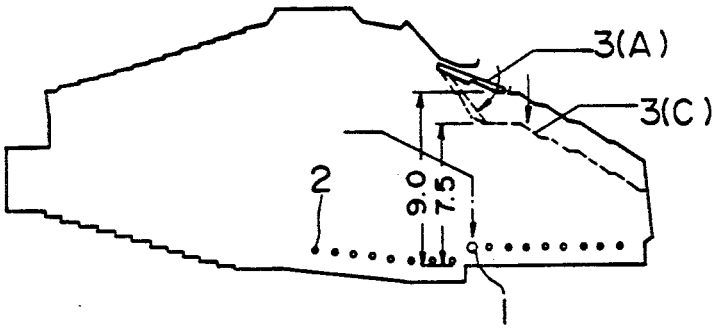
FIG. 11 is a schematic vertical cross-sectional view of a hall Z used for experimental purposes.
Figure 12A:
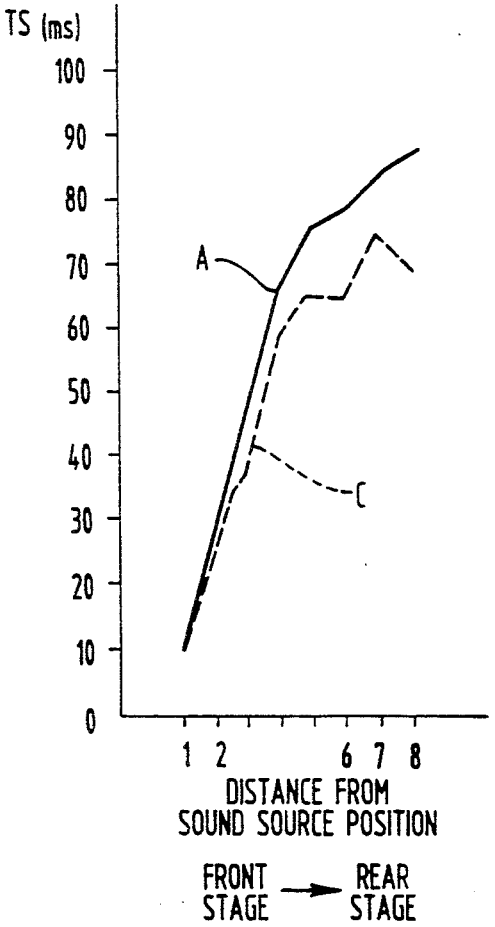
FIGS. 12A and 12B are a diagram for demonstrating the relationshipp between measurement position and the center of gravity time ts with respect to time in hall Z which is shown in FIG. 11.
Figure 12B:
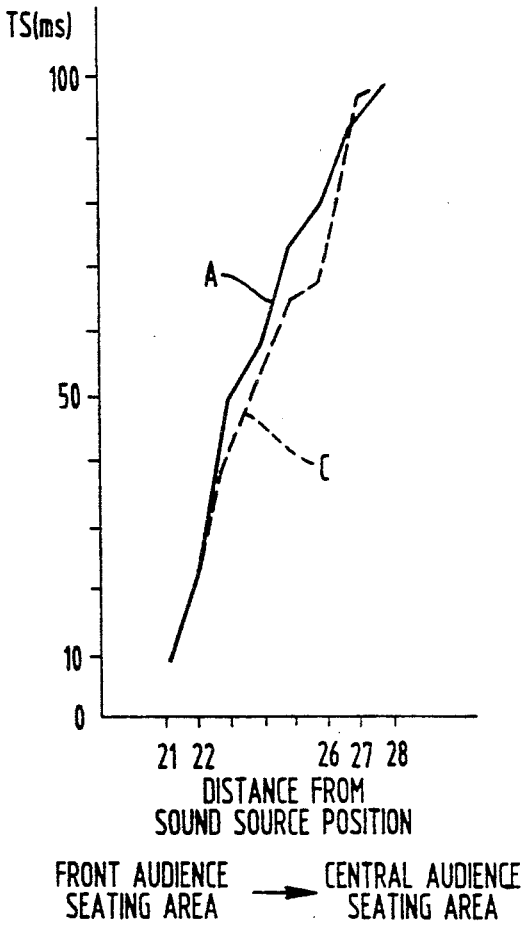

To describe the process concretely, as shown FIG. 4 a sound source 30 for generating the impulse, for example a blank gun, is placed within the hall 10. The sound is then, radiated from the sound source 30, and the sound waves are collected at microphones 31 in order to measure the impulse response r(x). The signal from microphones 31 is then amplified in amplifier 32, the output of which is graphically shown in FIG. 5A. The amplified analog signal is then converted to a digital signal in A/D converter 33.

The digitally converted impulse response r(x) is supplied to squaring circuit 34 wherein the digital value corresponding to the square of r(x) is obtained and provided to accumulator 35. In accumulator 35, the integral of the square of the impulse response r(x) for each interval making up the integration interval <0 to T> (0 to $t_1$, $t_1$ to $t_2$, . . . $t_{n-2}$ to $t_{n-1}$, $t_{n-1}$ to $t_n$=t, $t_n$ to $t_{n+1}$, . . . $t_{n+m-2}$ to $t_{n+m-1}$, $t_{n+m-1}$ to $t_{n+m}$=T) is determined, the results of which are sequentially summed. Each sequential accumulated result in accumulator 35 is supplied to and stored in a first memory device, RAM (Random Access Memory) 36. In FIG. 5B, digital data values sequentially stored in RAM 36 are shown an analog values. As thus described, the final accumulated result stored in RAM 36 represents an approximation of the integral of the square the impulse response r(x) over the integration interval 0 to T.

The above described A/D converter 33, squaring circuit 34 and accumulator 35 are all operated in coordination with a reference clock rate fs (comparatively high frequencey), as it shown in FIG. 4. The writing of data to the above mentioned RAM 36 is controlled at clock rate fL ($fs \times 2^{-k}$), which is slower than clock rate fs. The size of the increments (0 to $t_1$, $t_1$ to $t_2$, . . . $t_{n-2}$ to $t_{n-1}$, $t_{n-1}$ to $t_n = t$, $t_n$ to $t_{n+1}$, . . . $t_{n+m-2}$ to $t_{n+m-1}$, $t_{n+m-1}$ to $t_{n+m} = T$) which are used to operate an approximation of the integral of $r^2(x)$ over the integration interval 0 to T, are chosen so that the approximate integration result obtained from summing the integral of $r^2(x)$ over each increment is of the desired level of precision. Accordingly, when it is desirable to provide data of high precision, an appropriately high clock rate fs is chosen so as to achieve correspondingly small increments of integration.

The fiinal accumulated result supplied from accumulator 35 which represents an approximation of the integral of the square of the impulse response r(x) over the integration interval 0 to T is stored to a second memory device, register 37. After this value has thus been obtained, it is repeatedly supplied to a subtraction circuit 38 together with one of the intermediate integration results stored in RAM 36, which are sequentially read out with each occurrence of a synchronization pulse, the pulse also coordinating the repeated readout of the single value in register 37. In subtraction circuit 38, each intermediate integration result is subtracted from the final integration results supplied from register 37, thus calculating consecutive values corresponding to:

$$<S^2(t)> = N \int_t^T r^2(x)dx$$

as a function of time. These results are graphically shown in FIG. 5(*c*) as a function of time, expressed as analog values. It can be seen from this graph that as t approaches T, $<S^2(t)>$ approaches zero.

The results operated in subtraction circuit 38 are then converted to logarithmic values in logarithmic compression circuit 39, using for example, a data table stored in ROM (Read Only Memory). These results shown in FIG. 5(*c*), are shown in FIG. 5(*d*) again, after logarithmic conversion in logarithmic compression circuit 39. Thus separated, these logarithmic results are supplied to display and storage unit 41, via interface 40.

As thus described, the impulse response collected by microphone is digitally converted and subjected to various operations, whereby the response characteristics, in other words the reverberation characteristics of hall 10, are obtained as a function of time, then stored and displayed in quasi-real time in display and storage unit 41. From these results, the center of gravity time ts of the stage area Rand that of the audience seating area 13 are measured and thereafter, the ratio of their ts values can be easily obtained.

In the following, control of reverberation characteristics using the system for improving the acoustical characteristics of hall 16 of the present invention will be explained.

2. Control of Reverberation Characteristics

Using the previously described first assisted acoustics system 17 and second assisted acoustics system 18, and the respective reverberation digitall signal processor 22 of each, the acoustic characteristics of hall 10 are regulated so as to obtain a value for $ts_{ratio}$ as described above which approaches unity.

Fundamentally, the above mentioned reverberation digital signal processor 22 includes two types of filters, a finite impulse response (FIR) filter and an infinite impulse response (IIR) filter. By carrying out convolution operations, the above mentioned FIR filter creates simulated early reflection sound. On the other hand, the IIR filter creates simulated early reverberation sound, thereby affecting reverberation characteristics.

Through the operation of remote mixer 20 and digitally controlled attenuator 23, in reponse to the level of input sound, digital signal processor 22 and associated circuits are controlled over a suitable dynamic range, whereby automatic operation in accordance with the input mixing level and output compensation level can be achieved. Through operation of equalizer 21 so as to effect selective filtering at frequencies where acoustic feedback is likely to be generated by the above mentioned first assisted acoustics system 17 and second assisted acoustics system 18, howling can easily and effectively be controlled, even when the overall loop gain is increased.

Through operation of the first and second assisted acoustics systems 17, 18 so as to achieve a value of $ts_{ratio}$ approaching unity, acoustic characteristics for hall 10 approaching those of a one-room-type-hall can be effected. Additionally, if desired, the acousticall effects of other types of halls, rooms, etc. can be achieved.

Thus, with the system of the present invention, by carrying out an objective evaluation of the presence of throughout the stage area and the main audience seating area of a target hall, control of acoustical effects on the basis of this evaluation can be effected such that the acoustic characteristics throughout the hall are brought into uniformity, whereby it is possible to create an effect approaching the presence of the chamber of a one-room-type-hall, even in a hall in which the stage area and the audience seating area are physically different from one another.

Moreover, through use of the system of the present invention in halls including one or more balcony areas, improved acoustic similarity in and under the balcony areas with the rest of the hall can be effected, thereby achieving acoustic characteristics in these areas which are in conformity with those of the audience seating area and stage area.

In an actual experimental installation, the present inventors found that in a hall for which for $ts_{ratio}$ was normally 1.21 between the stage and main audience seating area, operation of the system of the invention could achieve values for $ts_{ratio}$ ranging from 1.07 to 1.37. Furthermore, $ts_{ratio}$ between the main audience seating area and the sub-balcony area for the same hall was normally 0.78, however, a $ts_{ratio}$ value between the main audience seating area and sub-balcony area of 0.94 was possible using the system of the present invention.

What is claimed is:

1. An apparatus for controlling a sound field in auditoriums having at least a stage area and a main audience seating area, comprising:

a first assisted acoustics means comprising;

a first input means for inputting acoustic energy in the stage area;

a first control means for electrically controlling the acoustic energy input by said first input means;

a first output means for outputting the controlled acoustic energy of said first control means to the main audience seating area;

a second assisted acoustics means comprising;

a second input means for inputting acoustic energy in the main audience seating area;

a second control means for electrically controlling the acoustic energy input by said second input means;

a second output means for outputting the controlled acoustic energy of said second control means to the stage area;

wherein said first and second control means are controlled so that a power decay coefficient of the stage area and a power decay coefficient of the main audience seating area come to equal one another.

2. An apparatus for controlling a sound field according to claim 1 wherein said first assisted acoustics means and said second assisted acoustics means are independent of each other.

3. An apparatus controlling a sound field in auditoriums in accordance with claim 1 above, wherein said first assisted acoustics means electrically controls the reverberation characteristic of acoustic energy input from in the stage area, after which the acoustic energy is supplied to the main audience seating area.

4. An apparatus controlling a sound field in auditoriums in accordance with claim 1 above, wherein said second assisted acoustics means electrically controls the reverberation characteristic of acoustic energy input in the main audience seating area, after which the acoustical energy is supplied to the stage area.

5. An apparatus controlling a sound field in auditoriums in accordance with claim 4 above, wherein said first assisted acoustics means electrically controls the reverberation characteristic of acoustic energy input the stage area, after which the acoustic energy is supplied to the main audience seating area.

6. An apparatus controlling a sound field in auditoriums in accordance with claim 1 above, wherein the auditoriums have a balcony and a sub-balcony area positioned under the balcony and said second assisted acoustics means includes said second output means provided under the balcony.

7. An apparatus controlling a sound field in auditoriums in accordance with claim 1 above, wherein each of said first and second control means of said first and second assisted acoustics means includes a FIR digital filter, wherein the FIR filter performs a convolution operation, thereby creating simulated early reflection sound.

8. An apparatus for controlling a sound field in auditoriums in accordance with claim 1 above, wherein each of said first and second control means of said first and second assisted acoustics means includes an IIR digital filter wherein said IIR digital filter creates simulated reverberation sound.

9. An apparatus controlling a sound field in auditoriums in accordance with claim 1 above, wherein each of said first control means and second control means includes a mixer, attenuator and equalizer, whereby the mixer and attenuator of said first control means and said mixer and attenuator of said second control means are each operated so that said first and second control means are respectively operates over a suitable dynamic range, said operation automatically carried out in accordance with input mixing level and output compensation level, and wherein the equalizers effect selective filtering at frequencies at which howling is likely to be generated.

10. An apparatus controlling a sound field in auditoriums in accordance with claim 1 above further comprising reverberation characteristic measurement means for measuring reverberation characteristic of said stage area and said main audience seating area.

11. A system for improving the acoustical characteristics of halls in accordance with claim 10 above, wherein said first assisted acoustics means electrically controls the reverberation characteristic of acoustic energy input in the stage area, after which the acoustic energy is supplied to the main audience seating area.

12. A system for improving the acoustical characteristics of halls in accordance with claim 10 above, wherein said second assisted acoustics means electrically controls the reverberation characteristic of acoustic energy input in the main audience seating area, after which the acoustic energy is supplied to the stage area.

13. A system for improving the acoustical characteristics of halls in accordance with claim 12 above, wherein said first assisted acoustics means electrically controls the reverberation characteristicc of acoustic energy input in the stage area, after which the acoustic energy is supplied to the main audience seating area.

14. A system for improving the acoustical characteristics of halls in accordance with claim 10 above, wherein the auditoriums have a balcony and a sub-balcony area positioned under the balcony and said second assisted acoustics means includes said second output means provided under the balcony.

15. A system for improving the acoustical characteristics of halls in accordance with claim 10 above, wherein each of said first and second assisted acoustics means includes a FIR digital filter wherein said FIR filter performs a convolution calculation, thereby creating simulated early reflected sound.

16. A system for improving the acoustical characteristics of halls in accordance with claim 10 above, wherein each of said first and second assisted acoustics means includes an IIR digital filter wherein said IIR digital filter creates simulated reverberation sound.

17. A system for improving the acoustical characteristics of halls in accordance with claim 10 above, wherein each of said first control means and second control means includes a mixer, attenuator and equalizer, whereby the mixer and attenuator of said first control means and said mixer and attenuator of said second control means are each operated so that said first and second control means are respectively operates over a suitable dynamic range, said operation automatically carried out in accordance with input mixing level and output compensation level, and wherein the equalizers effect selective filtering at frequencies at which howling is likely to be generated.

18. Method for controlling the sound field in auditoriums having at least a stage area and a main audience seating area, comprising the steps of:

inputting acoustic energy in the stage area;

electrically controlling the first input acoustic energy of the stage area;

outputting the first controlled acousticc energy to the main audience seating area;

inputting acoustic energy in the main audience seating area;

electrically controlling the second input acoustic energy of the main audience seating area;

outputting the second controlled acoustic energy to the stage area;

wherein the first and second controlled acoustic energy are output respectively so that a power decay coefficient of the stage area and a power decay coefficient of the main audience seating area come to equal one another.

* * * * *